US008164015B2

(12) United States Patent
Tatehata et al.

(10) Patent No.: US 8,164,015 B2
(45) Date of Patent: Apr. 24, 2012

(54) MOVABLE CONTACT UNIT AND SWITCH USING THE SAME

(75) Inventors: Naoki Tatehata, Kyoto (JP); Yousuke Chikahisa, Hyogo (JP); Tsutomu Aisaka, Osaka (JP); Koji Tanabe, Osaka (JP)

(73) Assignee: Panasonic Corporation, Osaka (JP)

( * ) Notice: Subject to any disclaimer, the term of this patent is extended or adjusted under 35 U.S.C. 154(b) by 246 days.

(21) Appl. No.: 12/668,910

(22) PCT Filed: Feb. 20, 2009

(86) PCT No.: PCT/JP2009/000722

§ 371 (c)(1),
(2), (4) Date: Jan. 13, 2010

(87) PCT Pub. No.: WO2009/107344

PCT Pub. Date: Sep. 3, 2009

(65) Prior Publication Data

US 2010/0187077 A1 Jul. 29, 2010

(30) Foreign Application Priority Data

Feb. 28, 2008 (JP) ..... 2008-047047

(51) Int. Cl.
*H01H 9/00* (2006.01)

(52) U.S. Cl. ..... 200/310

(58) Field of Classification Search ..... 200/310–311, 200/314, 344, 406, 516, 512–513, 5 A; 362/602
See application file for complete search history.

(56) References Cited

U.S. PATENT DOCUMENTS

| | | | | |
|---|---|---|---|---|
| 6,590,174 | B2 * | 7/2003 | Zysnarski et al. | 200/310 |
| 7,186,935 | B2 * | 3/2007 | Lee et al. | 200/310 |
| 7,655,878 | B2 * | 2/2010 | Nishimura | 200/512 |
| 7,786,394 | B2 * | 8/2010 | Gao et al. | 200/314 |
| 2007/0039809 | A1 | 2/2007 | Aihara et al. | |
| 2007/0279932 | A1 | 12/2007 | Ishihara et al. | |

FOREIGN PATENT DOCUMENTS

| | | |
|---|---|---|
| JP | 10-144172 | 5/1998 |
| JP | 2004-234958 | 8/2004 |
| JP | 2007-087749 | 4/2007 |
| JP | 2007-324100 | 12/2007 |

OTHER PUBLICATIONS

International Search Report issued May 19, 2009 in International (PCT) Application No. PCT/JP2009/000722.

* cited by examiner

*Primary Examiner* — Edwin A. Leon
(74) *Attorney, Agent, or Firm* — Wenderoth, Lind & Ponack, L.L.P.

(57) ABSTRACT

A movable contact unit includes a light-guide sheet, a cover sheet, a movable contact, and a light-transmissive light-guide portion. The light-guide sheet includes a film-shaped substrate, and a convex and concave luminescent portion provided on the substrate. The cover sheet faces the substrate. A dome-shaped resilient movable contact made of a thin metal sheet is attached to the cover sheet at a position corresponding to the luminescent portion. The light-guide portion is provided on the cover sheet at a position other than an area where the movable contact is disposed or on the light-guide sheet at a position other than an area where the light-guide portion is disposed. If the light-guide portion is provided on the light-guide sheet, the movable contact may be attached to the light-guide sheet without using the cover sheet.

20 Claims, 6 Drawing Sheets

FIG. 9 – PRIOR ART

FIG. 10 – PRIOR ART
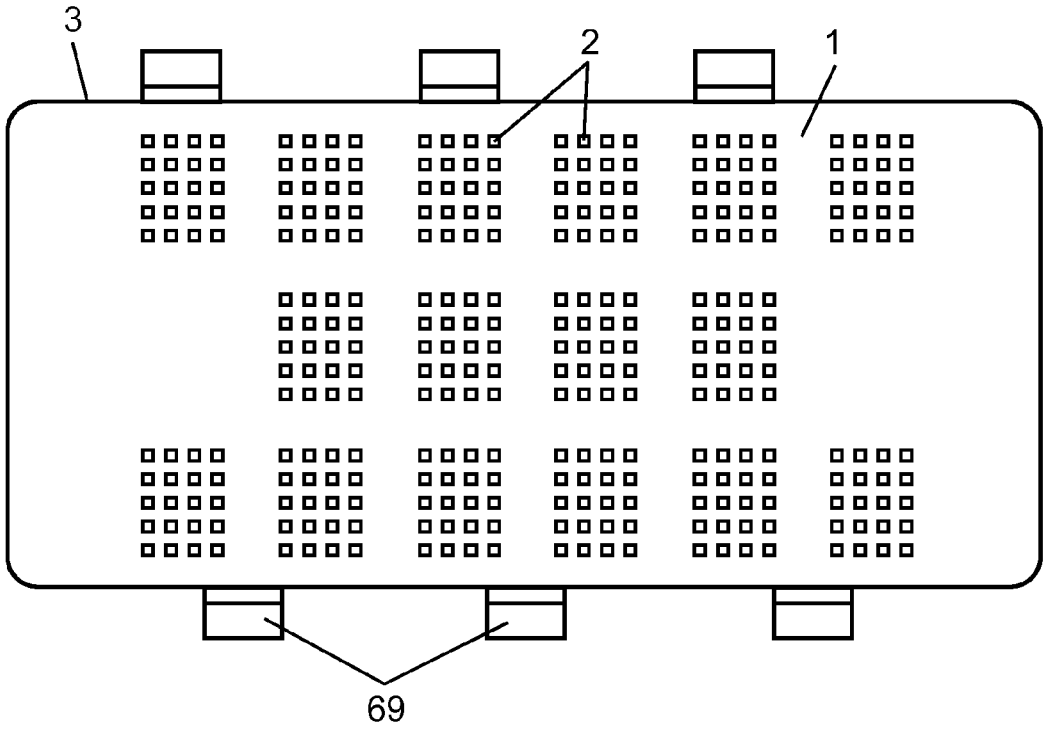

MOVABLE CONTACT UNIT AND SWITCH USING THE SAME

This application is a U.S. national phase application of PCT International Application PCT/JP2009/000722, filed Feb. 20, 2009.

TECHNICAL FIELD

The present invention relates to a movable contact unit for operating a range of electronic devices, and a switch employing the movable contact unit.

BACKGROUND ART

Recent electronic devices, typically mobile information terminals such as mobile phones, increasingly adopt light-emitting diodes or electroluminescent (EL) elements for lighting their control panels. This is to facilitate the identification and operation of buttons and display sheets, even in the dark. Movable contact units and switches that are easy to use and can be illuminated in diverse ways are also in demand in these devices.

A conventional movable contact unit and a switch are described next with reference to FIGS. 9 and 10. To facilitate understanding of the structure, dimensions are partially enlarged in these drawings. FIG. 9 is a sectional view and FIG. 10 is a plan view of the conventional switch. This switch includes movable contact unit 6, wiring board 67, light-emitting elements 69, and display sheet 70.

Movable contact unit 6 includes light-guide sheet 3, cover sheet 4, and movable contacts 65. Light-guide sheet 3 includes substrate 1 and luminescent portions 2. Film-shaped substrate 1 is light transmissive. Each of convex and concave luminescent portions 2 is provided in a predetermined area on the top face of substrate 1.

Cover sheet 4 is film-shaped, and each of movable contacts 65 is made of a dome-shaped thin metal sheet. Cover sheet 4 is attached to the bottom face of light-guide sheet 3 with adhesive (not illustrated) at predetermined portions of the outer periphery thereof. Each of movable contacts 65 is attached to the bottom face of cover sheet 4 under one of luminescent portions 2.

Wiring patterns (not illustrated) are formed on the top and bottom faces of wiring board 67. Fixed contacts 68 are provided on the top face of wiring board 67. Each of fixed contacts 68 includes substantially round central fixed contact 68A and substantially U-shaped or ring-shaped outer fixed contact 68B around central fixed contact 68A.

Movable contact unit 6 is attached to the top face of wiring board 67 such that the outer periphery of each movable contact 65 is placed on outer fixed contact 68B, and the center of the bottom face of movable contact 65 faces central fixed contact 68A with a predetermined distance in between.

Light-emitting element 69 is configured typically with a light-emitting diode. Light-emitting elements 69 are mounted on the top face of wiring board 67 at the side of light-guide sheet 3 so that a light-emitting face thereof is disposed facing the end face of substrate 1.

Film-shaped display sheet 70 is light transmissive. Light-shielding portion 70A and display portions 70B are formed on the bottom face of display sheet 70. Light-shielding portion 70A is formed typically by printing. Display portions 70B are formed by cutting out the shape of the characters, symbols, etc., on predetermined portions of light-shielding portion 70A. Each display portion 70B is disposed over luminescent portion 2.

The switch as configured above is placed on an operating face of the electronic device. Central fixed contacts 68A, outer fixed contacts 68B, and light-emitting elements 69 are connected to an electronic circuit (not illustrated) of the electronic device via wiring patterns or the like.

When a user presses display sheet 70 at a position corresponding to one of display portions 70B, light-guide sheet 3 and cover sheet 4 dent, and a dome-like center of movable contact 65 is pressed. When a predetermined pressing force is applied to this center, movable contact 55 resiliently inverts downward with a click feeling, bringing the center of the bottom face of movable contact 65 down into contact with central fixed contact 68A. This contact electrically connects central fixed contact 68A and outer fixed contact 68B via movable contact 65.

When the user releases the pressing force on display sheet 70, movable contact 65 resiliently reverts upward due to its resilient recovery force. As a result, the center of the bottom face of movable contact 65 separates from central fixed contact 68A, and central fixed contact 68A and outer fixed contact 68B are electrically disconnected. The device is switched to each function by electrical connection and disconnection of fixed contact 68.

When power is supplied to light-emitting element 69 from the electronic circuit of the device, light-emitting element 69 emits light. This light enters light-guide sheet 3 from its end face, and propagates inward through light-guide sheet 13, causing a reflection in substrate 1. This light is further diffused and reflected in luminescent portion 2, and illuminates display portion 70B from beneath. The user can thus identify the indications on display portions 70B, such as characters or symbols, even if the surrounding area is dark. Accordingly, the user can operate the device with ease. This type of movable contact unit is disclosed, for example, in Japanese Patent Unexamined Publication No. 2007-87749.

In above conventional movable contact unit 6 and switch, the light of light-emitting elements 69 enters substrate 1 from the end face, and luminescent portions 2 emit light at once so as to illuminate each display portion 70B. Accordingly, display portions 70B are illuminated at once in only one luminescent color.

SUMMARY OF THE INVENTION

The present invention offers a movable contact unit with a simple structure that allows diverse ways of lighting, and a switch that employs this movable contact unit. The movable contact unit of the present invention includes a light-guide sheet, a cover sheet, a movable contact, and a light-transmissive light-guide portion. The light-guide sheet includes a film-shaped substrate and a convex and concave luminescent portion provided on the substrate. The cover sheet is disposed facing the substrate. The dome-shaped resilient movable contact made of a thin metal sheet is attached to the cover sheet at a position corresponding to the luminescent portion. The light-guide portion is provided on the cover sheet at a position other than an area where the movable contact is disposed, or on the light-guide sheet at a position other than an area where the luminescent portion is disposed. In a case that the light-guide portion is provided on the light-guide sheet, the movable contact may be attached to the light-guide sheet without using the cover sheet. With either of the above structures, the light-guide portions can be illuminated in different colors or at different times, in addition to lighting of the luminescent portion.

BRIEF DESCRIPTION OF DRAWINGS

FIG. 9 is a sectional view of a conventional switch.

FIG. 10 is a plan view of the switch shown in FIG. 9.

DETAILED DESCRIPTION OF PREFERRED EMBODIMENTS

Figure 1:
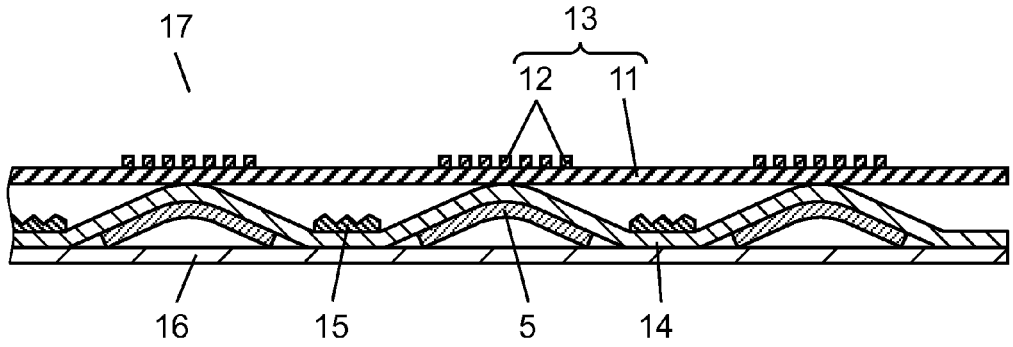
FIG. 1 is a sectional view of a movable contact unit in accordance with a first exemplary embodiment of the present invention.

Exemplary embodiments of the present invention are described below with reference to drawings. To facilitate understanding of each structure, dimensions are partially enlarged in the drawings.

First Exemplary Embodiment

Figure 2:
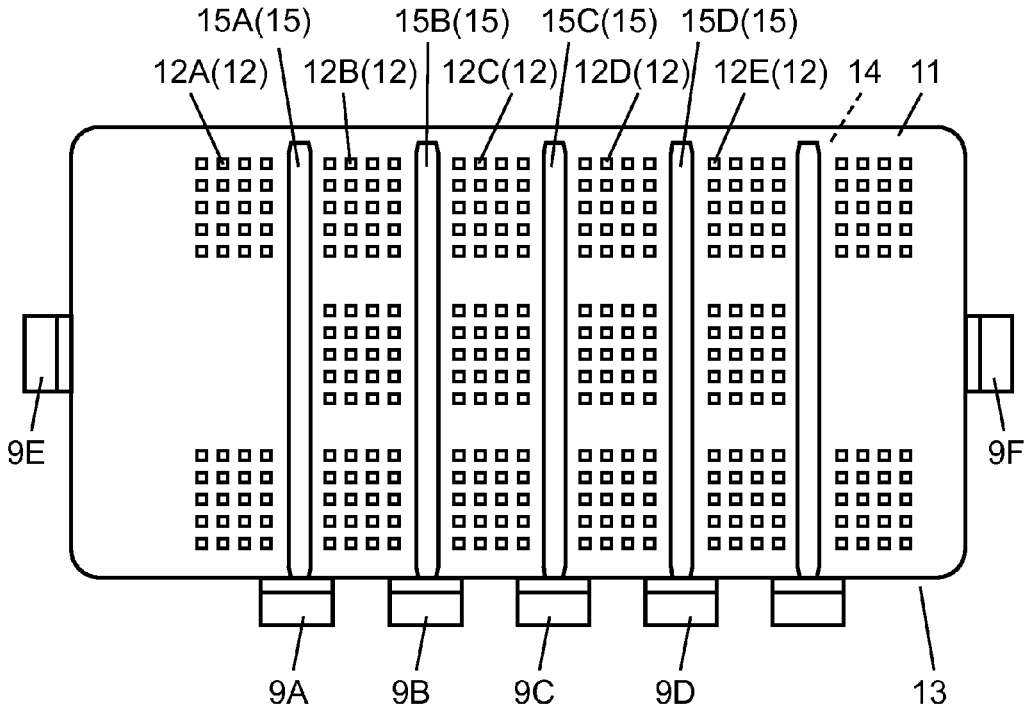
FIG. 2 is a plan view of the movable contact unit shown in FIG. 1.

FIG. 1 is a sectional view and FIG. 2 is a plan view of a movable contact unit in accordance with the first exemplary embodiment of the present invention. Movable contact unit 17 includes light-guide sheet 13, cover sheet 14, movable contacts 5, and light-guide portions 15 (15A, 15B, 15C, 15D, etc.).

Light-guide sheet 13 includes substrate 11 and luminescent portions 12. Film-shaped substrate 11 is light-transmissive, and is made of flexible resin such as polyethylene terephthalate, polycarbonate, polyurethane, and silicone. Convex and concave luminescent portions 12 are provided on the top face of substrate 11 at predetermined positions. Luminescent portions 12 are typically formed by printing a group of dots made of a material such as semi-transparent polyester and epoxy. Alternatively, convex and concave luminescent portions 12 may also be formed by molding or laser processing. Furthermore, luminescent portions 12 may be formed using a combination of these methods. Meanwhile, luminescent portions 12 may be formed on the bottom face of substrate 11.

Cover sheet 14 is film-shaped. Dome-shaped resilient movable contacts 5 are made of a thin metal sheet typically of copper alloy or steel. The outer periphery of cover sheet 14 is attached to the bottom face of light-guide sheet 13 by adhesive (not illustrated) at predetermined points. In other words, cover sheet 14 faces substrate 11. Movable contacts 5 are attached to the bottom face of cover sheet 14 at positions corresponding to luminescent portions 12, respectively. In other words, movable contacts 5 are attached to cover sheet 14 on a face opposite to the one facing light-guide sheet 13.

Light-transmissive light-guide portions 15 are provided on the top face of cover sheet 14 between movable contacts 5. In other words, light-guide portions 15 are provided on cover sheet 14 at positions other than areas where movable contacts 5 are disposed.

Light-guide portions 15 are made of light-transmissive sheet material, same as substrate 11, such as polyethylene terephthalate, polycarbonate, polyurethane, and silicone. This sheet material is processed to substantially a belt shape, and its top face or bottom face is roughened or concavo-convex to form light-guide portions 15. Light-guide portions 15 are attached to the top face of cover sheet 14 via adhesive.

In order to facilitate understanding, light-guide portions 15 are illustrated as an integral member, including adhesive, whose top face is roughened in the drawing. To make the top face or bottom face of light-guide portions 15 concavo-convex, dots typically made of semi-transparent polyester or epoxy may be printed, same as luminescent portions 12 on light-guide sheet 13.

As shown in FIG. 2, light-guide portion 15A is disposed below a position between luminescent portion 12A and luminescent portion 12B. In the same way, light-guide portion 15B is disposed below a position between luminescent portion 12B and luminescent portion 12C. Light-guide portion 15C is disposed below a position between luminescent portion 12C and luminescent portion 12D. Light-guide portion 15D is disposed below a position between luminescent portion 12D and luminescent portion 12E.

Accordingly, light-guide portions 15 are provided at positions other than areas where movable contacts 5 are disposed, i.e., positions between movable contacts 5. In other words, no light-guide portion 15 is disposed over movable contact 5, and thus the entire thickness will not increase. Accordingly, in comparison with a structure of overlaying light-guide sheets or light-guide portions over movable contact 5 so as to achieve diverse ways of lighting, the entire thickness does not increase. Diverse ways of lighting becomes thus feasible without increasing the thickness.

As shown in FIG. 1, the bottom face of cover sheet 14 is covered with film-shaped separator 16. Separator 16 is typically made of polyethylene terephthalate. Since separator 16 is attached such that it covers the entire bottom face of cover sheet 14, no dust or other particles adhere to the bottom faces of movable contacts 5 during storage and transportation.

Figure 3:
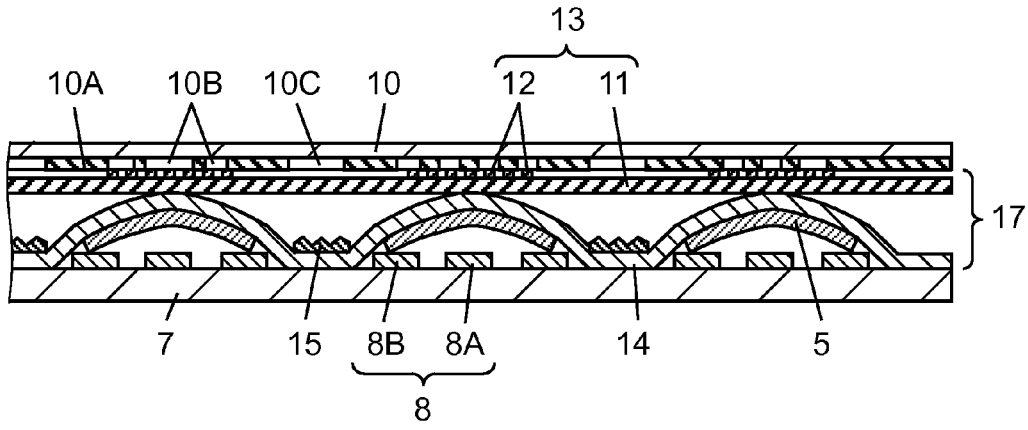
FIG. 3 is a sectional view of a switch employing the movable contact unit shown in FIG. 1.

Next, a switch employing movable contact unit 17 is described with reference to FIGS. 2 and 3. FIG. 3 is a sectional view of the switch employing movable contact unit 17. This switch includes movable contact unit 17, wiring board 7, light-emitting elements 9A to 9F, and display sheet 10.

Wiring board 7 is configured with a film typically of polyethylene terephthalate or polycarbonate, or a board typically of paper phenol or glass epoxy. Wiring patterns (not illustrated) are formed, typically using copper, on the top and bottom faces of wiring board 7. Fixed contacts 8 made of a conductive material, such as carbon, are disposed on the top face of wiring board 7. Each fixed contact 8 includes substantially round central fixed contact 8A and substantially U-shaped or ring-shaped outer fixed contact 8B around central fixed contact 8A.

Movable contact unit 17, after separator 16 is peeled off, is attached to the top face of wiring board 7. At this point, the outer periphery of each of movable contacts 6 is placed on corresponding outer fixed contact 8B, and the center of the bottom face of movable contact 5 faces central fixed contact 8A with a predetermined distance in between.

Light-emitting elements 9A to 9F are configured typically with light-emitting diodes. Light-emitting elements 9A to 9F are mounted on the top face of wiring board 7 at the side of light-guide sheet 13. More specifically, as shown in FIG. 2, light-emitting element 9A is disposed so that a light-emitting face thereof faces toward an end face of light-guide portion 15A on cover sheet 14. Light-emitting element 9B is disposed so that a light-emitting face thereof faces toward an end face of light-guide portion 15B. Light-emitting element 9C is disposed so that a light-emitting face thereof faces toward an end face of light-guide portion 15C. Light-emitting element 9D is disposed so that a light-emitting face thereof faces toward an end face of light-guide portion 15D. Light-emitting elements 9E and 9F are disposed so that light-emitting faces thereof face toward end faces of substrate 11. Light-emitting elements 9A to 9D are first light-emitting elements provided at positions enabling lighting of the ends of light-guide portions 15A to 15D. Light-emitting elements 9E and 9F are second light-emitting elements provided at positions enabling lighting of the ends of substrate 11.

Film-shaped display sheet 10 is light transmissive. Light-shielding portion 10A, display portions 10B, and light-transmissive portions 10C are formed on the bottom face of display sheet 10. Light-shielding portion 10A is formed typically by printing. Each display portion 10B is formed by cutting out a predetermined portion of light-shielding portion 10A into a character, symbol, and so on. Each display portion 10B is disposed over luminescent portion 12. Each light-transmissive portion 10C is formed by cutting out a predetermined portion of shielding portion 10A between display portions 10B. Light-transmissive portion 10C is, for example, substantially a belt shape. This configures the switch. The structure of display sheet 10 is not limited, in particular, to the above structure. For example, display sheet 10 may be configured with non-transmissive resin. Then, a part of display sheet 10 is cut out, and transparent resin is embedded in a cut-out portion to form a portion equivalent to light-transmissive portion 10C.

The switch as configured above is provided on a control panel of an electronic device, and central fixed contacts 8A, outer fixed contacts 8B, and light-emitting elements 9A to 9F are connected to an electronic circuit (not illustrated) of the device via a wiring pattern, and so on.

When a user presses down one of display portions 10B on display sheet 10, light-guide sheet 13 and cover sheet 14 dent, and a dome-shaped center of movable contact 5 is pressed. When a predetermined pressing force is applied, movable contact 5 resiliently inverts downward with a click feeling, bringing the center of the bottom face of movable contact 5 down into contact with central fixed contact 8A. This contact electrically connects central fixed contact 8A and outer fixed contact 8B via movable contact 5.

A columnar portion (not illustrated) may be further interposed between light-guide sheet 13 and cover sheet 14 at a position corresponding to the center of movable contact 5. With this structure, movable contact 5 is pressed via the columnar portion, making the operation feeling better. In other words, the columnar portion enables efficient transmission of the pressing force from the top face of display sheet 10 to movable contact 5. In addition, since the columnar portion is disposed corresponding to the center of movable contact 5, movable contact 5 is always pressed at its center part even if a pressed point of the user slightly deviates from the center of movable contact 5. Accordingly, the user receives a satisfactory tactile feedback.

When the user releases the pressing force on display sheet 10, movable contact 5 resiliently reverts upward due to its resilient recovery force, separating the center of the bottom face of movable contact 5 from central fixed contact 8A. Accordingly, central fixed contact 8A and outer fixed contact 8B are electrically disconnected. In this way, the device is switched to each function by electrical connection and disconnection of fixed contact 8.

Next is described the case of supplying power from an electronic circuit of the device to light-emitting elements 9A to 9F. For example, if the power is supplied to light-emitting elements 9E and 9F and they emit light, this light enters light-guide sheet 13 from the end face of substrate 11 and propagates inward through light-guide sheet 13, causing reflection in substrate 11. This light is diffused and reflected in luminescent portions 12 (12A, 12B, etc.) on the top face of substrate 11, and illuminates display portions 10B on display sheet 10 above luminescent portions 12 from beneath. Accordingly, display portions 10B are illuminated. This enables the user to identify the indications on display portions 10B, such as characters or symbols, even if the surrounding area is dark. The user can thus operate the device with ease.

When light-emitting element 9A emits light, this light enters light-guide portion 15A on cover sheet 14 from its end face, and propagates inward through light-guide portion 15A, causing reflection in light-guide portion 15A. The light is diffused and reflected in the top face of light-guide portion 15A, and entire light-guide portion 15A emits light. This light passes through substrate 11, and illuminates upper light-transmissive portion 10C from beneath.

In the same way, when light-emitting element 9B emits light, this light enters light-guide portion 15B from its end face, and entire light-guide portion 15B emits light. When light-emitting element 9C emits light, entire light-guide portion 15C emits light. When light-emitting element 9D emits light, entire light-guide portion 15D emits light. These lights pass through substrate 11, and illuminate from beneath light-transmissive portion 10C over each light-guide portion.

For example, light-emitting element 9E and light-emitting element 9F may emit light in white color, light-emitting element 9A in blue color, light-emitting element 9B in orange, and light-emitting element 9C in green. In this case, luminescent portions 12 emit light in white color, light-guide portion 15A in blue, light-guide portion 15B in orange, and light-guide portion 15C in green. Accordingly, display portions 10B and light-transmissive portion 10C in each line are illuminated in different colors, such as display portions 10B in white, and light-transmissive portions 10C between them in blue, orange, and green, respectively.

Alternatively, light-emitting elements 9A, 9B, and 9C emit light in the same color, and power is supplied from the electronic circuit of the device to light-emitting elements 9A to 9F with a certain time difference. This makes light-guide portion 15A between luminescent portion 12A and luminescent portion 12B emit light first, and then light-guide portion 15B between luminescent portion 12B and luminescent portion 12C emit light. After that, light-guide portion 15C between luminescent portion 12C and luminescent portion 12D emits light. In this way, light-guide portions 15A to 15C emit light sequentially, and light-transmissive portions 10C between display portions 10B are sequentially illuminated per line.

As described above, in the switch according to this exemplary embodiment, the top face of light-guide sheet 13 is pressed down when the user presses display sheet 10, and movable contact 5 resiliently inverts to electrically turn on fixed contact 8. Then, the light from light-emitting elements 9A to 9D enter light-guide sheet 13 and light-guide portions 15A to 15D on cover sheet 14 from their end faces, respectively. This structure makes luminescent portions 12 and light-guide portions 15A to 15D disposed below a portion between luminescent portions 12 emit light. Accordingly, display portions 10B of display sheet 10 and light-transmissive portions 10C between them are illuminated. In addition to illumination of display portions 10B, as described above, light-transmissive portions 10C between them can be illuminated in different colors or illuminated sequentially by setting different times. In other words, this simple structure can illuminate display portions 10B and light-transmissive portions 10C in diverse ways.

The above description refers to the structure of providing light-guide portions 15 on the top face of cover sheet 14 at positions other than areas where movable contacts 5 are disposed. Other than this structure, if cover sheet 14 is light-transmissive, light-guide portions 15 may be provided on the bottom face of cover sheet 14. Still more, single light-guide portion 15 may be provided.

In the above description, light-guide portion 15 is provided between movable contacts 5, and light-guide portion 15 has a substantially belt shape with a constant width. However, the shape of light-guide portion 15 is not limited to this. Variations in the shape of light-guide portion 15 are described next with reference to FIGS. 4 to 7. FIGS. 4 to 7 are plan views of the movable contact unit having a light-guide portion with different structures in this exemplary embodiment.

Figure 4:
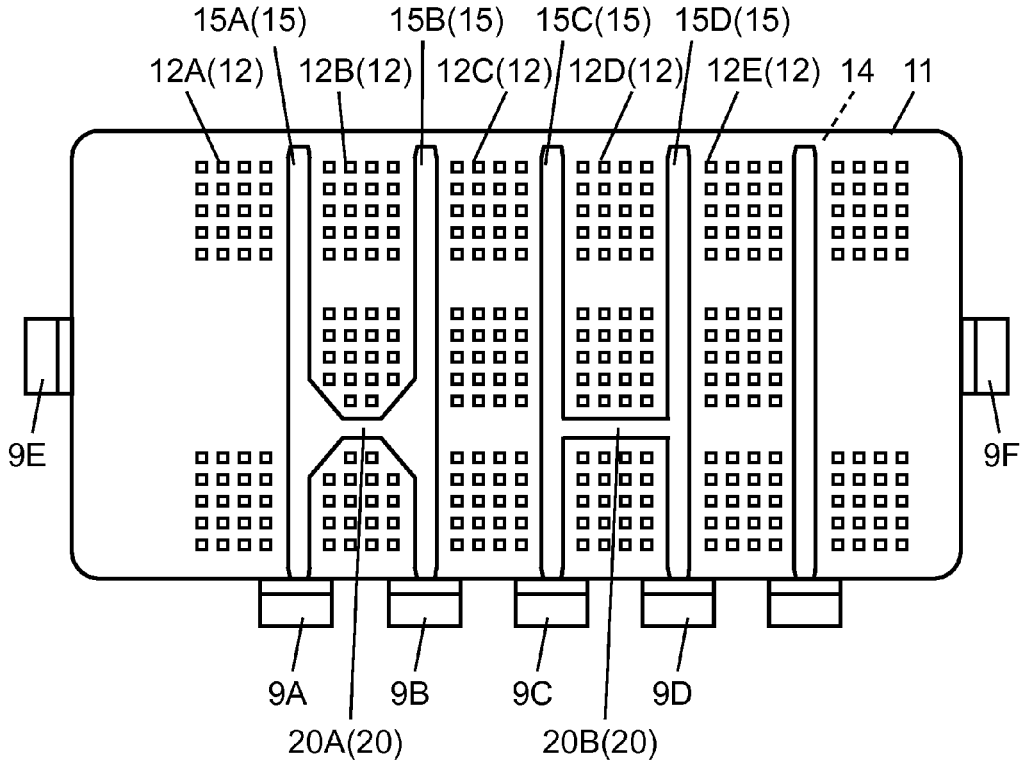
FIG. 4 is a plan view of a movable contact unit having a light-guide portion with another structure in accordance with the first exemplary embodiment of the present invention.

In a structure shown in FIG. 4, connecting portion 20A (20) is provided for partially connecting light-guide portion 15A and light-guide portion 15B at a position other than an area where movable contact 5 is disposed. Connecting portion 20B (20) is also provided for connecting light-guide portion 15C and light-guide portion 15D. In this structure, connecting portion 20A is integrally formed with light-guide portions 15A and 15B using the same material. Therefore, connecting portion 20A is also light transmissive. Light-guide portions 15A and 15B and connecting portion 20A thus emit light in the same state. Therefore, light-emitting elements 9A and 9B are preferably turned on at once in the same luminescent color. Alternatively, light-emitting elements 9A and 9B may emit light in different colors. In this case, light-transmissive portion 10C is set as required on display sheet 10, depending on the light-emitting state. This is same for light-guide portions 15C and 15D, connecting portion 20B, and light-emitting elements 9C and 9D.

In FIG. 4, connecting portion 20 is provided at one point relative to a pair of light-guide portions 15. Alternatively, connecting portions may connect a pair of light-guide portions 15. Light-guide portions 15C and 15D may also emit light in different colors or at different times relative to light-guide portions 15A and 15B.

Figure 5:
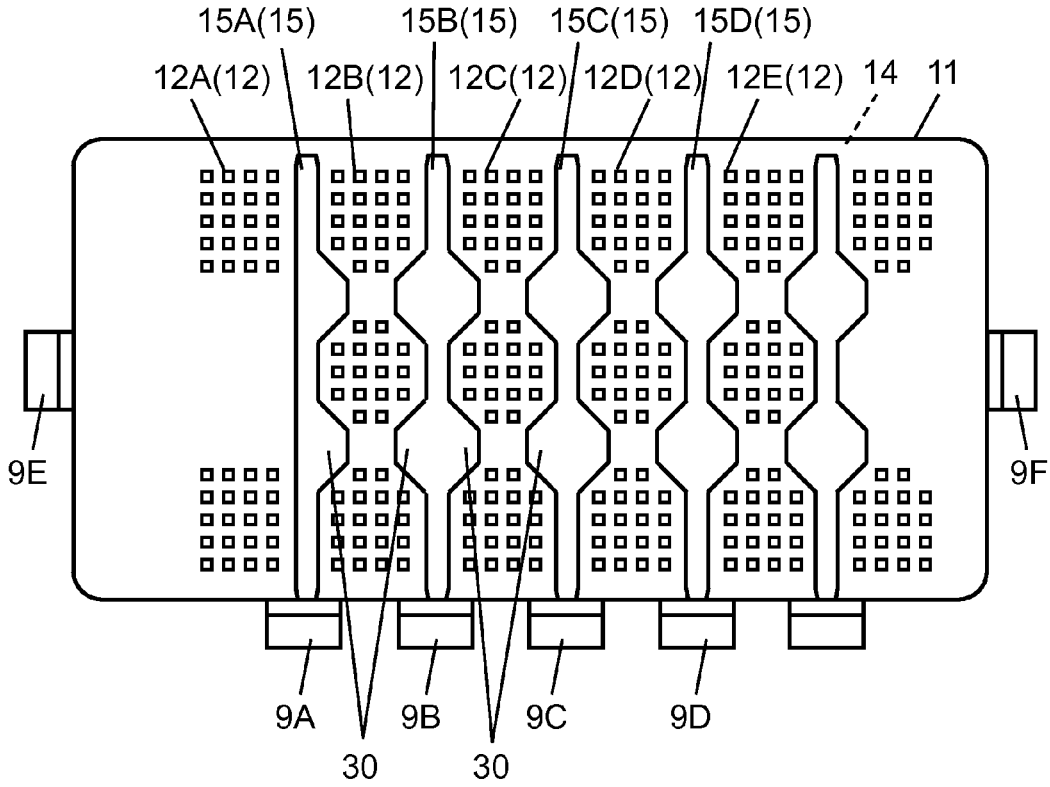
FIG. 5 is a plan view of a movable contact unit having a light-guide portion with still another structure in accordance with the first exemplary embodiment of the present invention.

Next, a structure shown in FIG. 5 is described. In general, the outer shape of movable contact 5 is round or oval when seen from the top. These movable contacts 5 with this shape are disposed in a matrix. On the other hand, luminescent portions 12A to 12E are disposed corresponding to positions of movable contacts 5. Therefore, a distance between luminescent portions 12A to 12E adjacent to each other in an oblique direction may be large. Therefore, as shown in FIG. 5 as an example, belt-shaped light-guide portions 15A, 15B, 15C, and 15D preferably have protrusions 30 integrally formed in a protruding state so as to fill a space between the luminescent portions adjacent to each other in the oblique direction. In other words, it is preferable to partly change the width of belt-shaped light-guide portion 15. This shape allows preferable light emission from the light-guide portions in a broad area including the space between adjacent portions in the oblique direction. A position to change the width is not limited to the above position. The position and the shape of protrusions 30 may be set as required. Light-guide portion 15 with protrusion 30 can illuminate an area where no luminescent portion 12 is provided.

Figure 6:
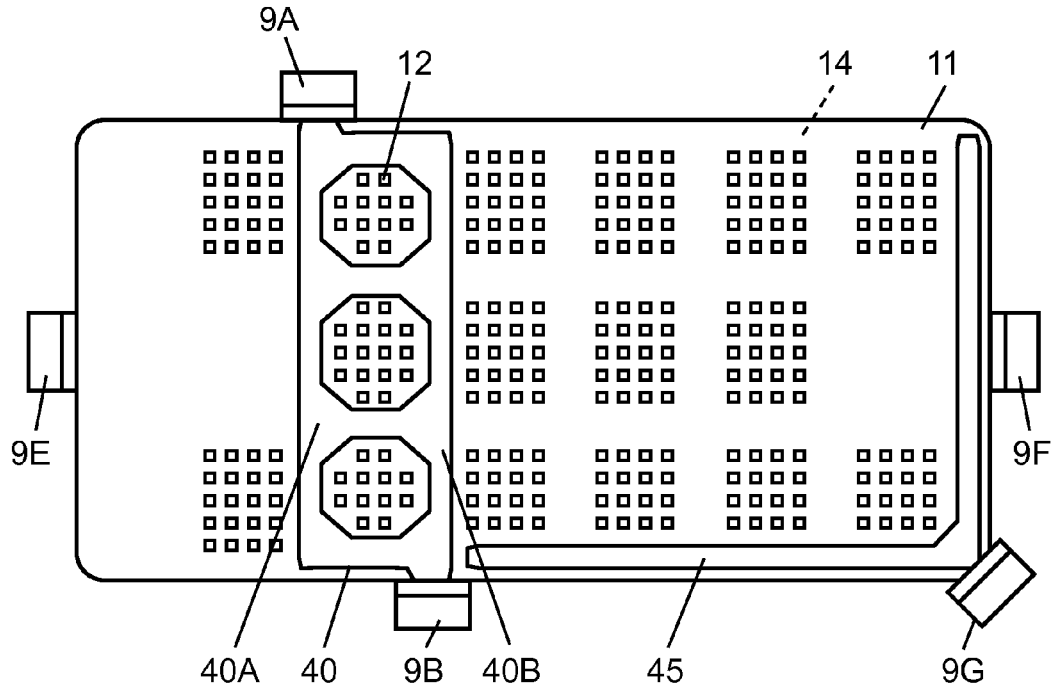
FIG. 6 is a plan view of a movable contact unit having a light-guide portion with still another structure in accordance with the first exemplary embodiment of the present invention.

Next, a structure shown in FIG. 6 is described. In the structure shown in FIG. 6, light-guide portion 40 provided on cover sheet 14 surrounds luminescent portions 12 disposed corresponding to positions of movable contacts 5. In addition, as shown in FIG. 6, lines (in a vertical direction in this drawing) including luminescent portions 12 may be integrally connected at three parts. Put another way, light-guide portion 40 has a shape in which connecting portion 20 is provided to connect belt-shaped light-guide portions 15A and 15B shown in FIG. 4 at all areas except for areas where movable contacts 5 are disposed. In this case, light-emitting elements 9A and 9B may be disposed at positions such that the light enters from ends of portions equivalent to belt-shaped portions 40A and 40B, respectively. In addition, light-guide portion 45 in a straight L-shape may be provided on an outer periphery of cover sheet 14, and light-emitting element 9G may be disposed such that the light of light-emitting element 9G enters from a corner of the L-shape. In other words, light-guide portion 45 is disposed on the outer periphery of the movable contact unit. Accordingly, cover sheet 14 is satisfactorily illuminated up to an edge of the outer periphery when light-guide portion 45 emits light.

Figure 7:
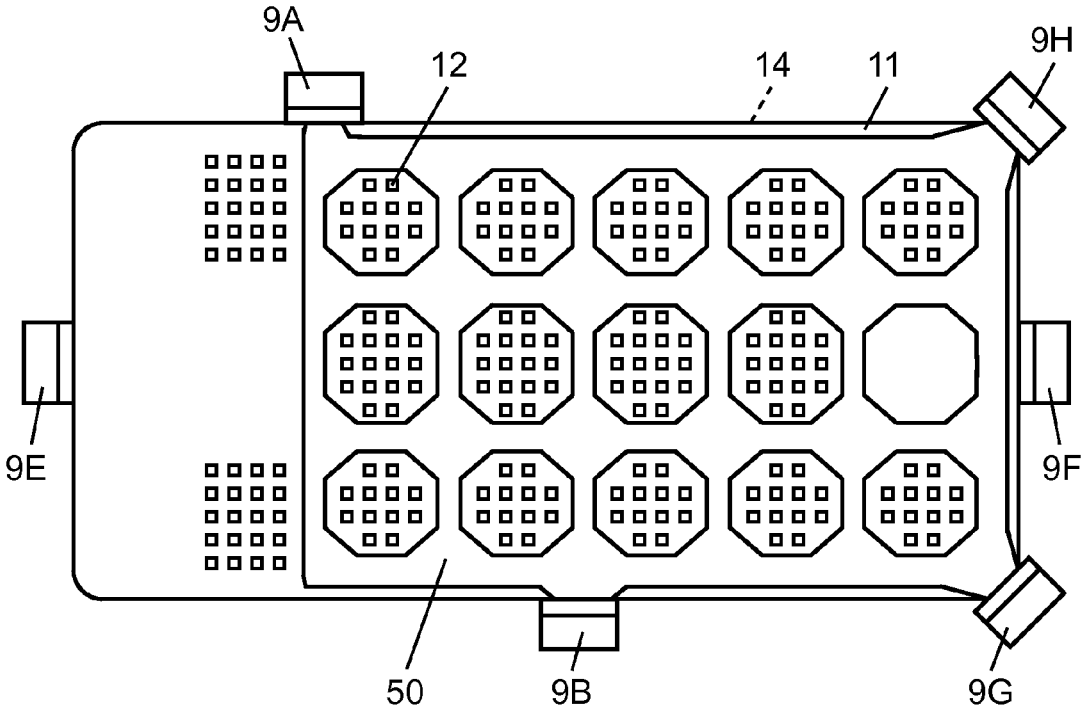
FIG. 7 is a plan view of a movable contact unit having a light-guide portion with still another structure in accordance with the first exemplary embodiment of the present invention.

Next, a structure shown in FIG. 7 is described. In this structure, net-like light-guide portion 50 is provided such that it surrounds each of luminescent portions 12 disposed in matrix. This structure is a variation of the structure shown in FIG. 6. In this case, light-emitting elements 9A, 9B, 9G, and 9H are preferably disposed at positions for uniform light emission as a whole. However, positions are not limited.

As described above, the light-guide portion can be disposed at any position, except for an area where movable contact 5 is disposed, with any length, thickness, and shape. In addition, by providing the light-emitting elements relative to the light-guide portions, a thin structure enables lighting in an arranged pattern and diverse light-emissions in a broad area. Display sheet 10 may have light-transmissive portion 10C corresponding to expected light emission, or another member having light-transmissive portion 10C may be used instead of display sheet 10. Each of the above light-guide portions may also be provided on the bottom face of cover sheet 14 instead of its top face.

As described above, movable contacts 5 are provided underneath luminescent portions 12, and the light-transmissive light-guide portions are provided at positions other than an area where movable contacts 5 are provided in this exemplary embodiment. This structure enables light-emission from the light-guide portions in different colors or at different times, in addition to light-emission from luminescent portions 12. Accordingly, a movable contact unit that can be illuminated in diverse ways with a simple structure can be manufactured.

Second Exemplary Embodiment

Figure 8:
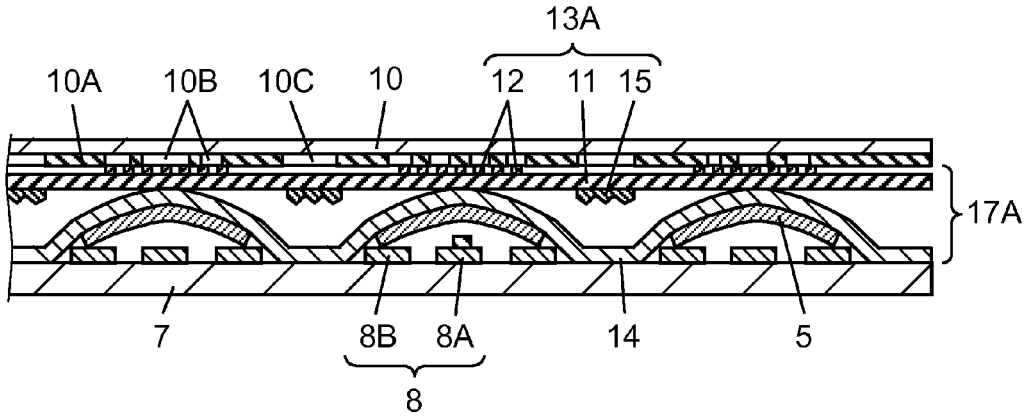
FIG. 8 is a sectional view of a switch in accordance with a second exemplary embodiment of the present invention.
Figure 8:
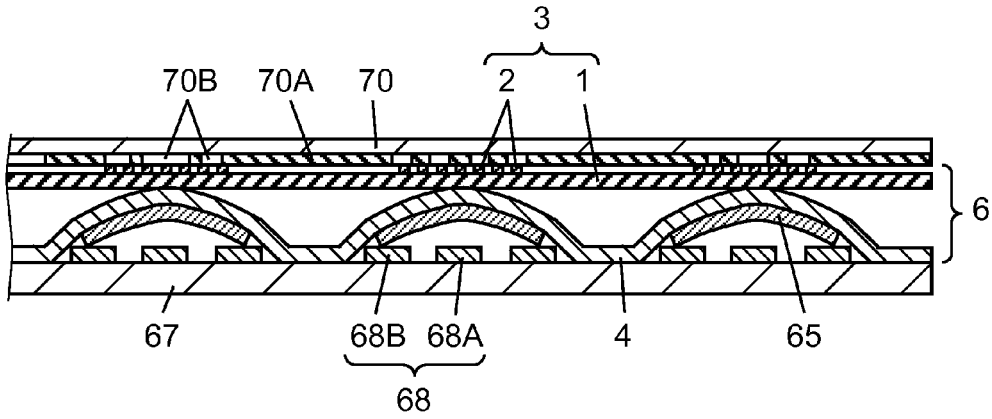

The second exemplary embodiment of the present invention is described below with reference to FIG. 8. FIG. 8 is a sectional view of a switch in accordance with the second exemplary embodiment of the present invention. Components same as those in the first exemplary embodiment are given the same reference marks to omit detailed description.

The switch in this exemplary embodiment includes movable contact unit 17A instead of movable contact unit 17 shown in FIG. 3 in the first exemplary embodiment. Movable contact unit 17A includes light-guide sheet 13A instead of light-guide sheet 13 in the first exemplary embodiment. Light-guide sheet 13A includes substrate 11, luminescent portions 12, and light-guide portions 15. More specifically, convex and concave luminescent portions 12 are provided at predetermined positions on the top face of film-shaped substrate 11. This is the same as light-guide sheet 13. Light-transmissive belt-shaped light-guide portions 15 are provided on the bottom face of substrate 11 between luminescent portions 12. Further more specifically, light-guide portions 15 are provided on light-guide sheet 13A at positions other than an area where luminescent portions 12 are disposed. In movable contact unit 17A, light-guide portions 15 are provided on the bottom face of substrate 11, instead of the top face of cover sheet 14. Other structures are the same as that in the first exemplary embodiment shown in FIG. 3.

Light-guide portion 15 is made of the same material and formed by the same method as the first exemplary embodiment, and thus their description is omitted here. The bottom face of light-guide portion 15 is roughened. In FIG. 8, light-guide portions 15 are illustrated as an integral member including adhesive for attachment. These characteristics are also the same as the first exemplary embodiment. In addition, light-guide portions 15 are not limited to the belt shape with a constant width. Light-guide portions 15 may be connected or partly have a different width. This is also the same as the first exemplary embodiment.

Instead of providing light-guide portions 15 on the bottom face of substrate 11 at positions between luminescent portions 12, light-guide portions 15 may be provided on the top face of substrate 11 at positions between luminescent portions 12. The above description refers to the structure of attaching cover sheet 14, to which movable contacts 5 are attached at its bottom face, to the bottom face of light-guide sheet 13A. Alternatively, cover sheet 14 may be eliminated, and movable contacts 5 may be directly attached to the bottom face of light-guide sheet 13A. This structure reduces the number of components, and thus the movable contact unit becomes further inexpensive.

As described above, light-transmissive light-guide portions 15 are provided on light-guide sheet 13A between luminescent portions 12 where movable contacts 5 are disposed. Also with this structure, luminescent portions 12 on light-guide sheet 13A emit light, and light-guide portions 15 between them also emit light in different colors or at different times. Accordingly, same as the first exemplary embodiment, movable contact unit 17A that can be illuminated in diverse ways with a simple structure can be manufactured. Structures shown in FIGS. 4 to 7 are also applicable to this exemplary embodiment.

The first and second exemplary embodiments refer to the light-transmissive light-guide portion made by forming a film-shaped sheet of a predetermined material into a predetermined shape, and attaching this light-guide portion to cover sheet 14 or substrate 11 using adhesive. Alternatively, the light-guide portion may be formed by printing. Or, the light-guide portion with refractive index different from that of cover sheet 14 and substrate 11 may be formed inward on the top and bottom faces of cover sheet 14 or substrate 11 by two-color molding. The present invention is made feasible also with these manufacturing methods. The light-guide portions may be connected or their width may be partly changed also in these manufacturing methods. In addition, the light-guide portions may emit light in different colors, at different times, or in the same color.

The movable contact unit of the present invention has a simple structure, and the present invention enables the manufacture of the movable contact unit and the switch that can be illuminated in diverse ways. They are effectively applicable to electronic devices for their operation.

The invention claimed is:

1. A movable contact unit comprising:

a light-guide sheet including a film-shaped substrate; and a convex and concave luminescent portion provided on the substrate;

a cover sheet facing the substrate;

a movable contact attached to the cover sheet at a position corresponding to the luminescent portion, the movable contact being made of a dome-shaped resilient thin metal sheet; and a light-transmissive light-guide portion provided on one of the cover sheet at a position other than an area where the movable contact is disposed, the light-guide portion overlapping the cover sheet at the position, and the light-guide sheet at a position other than an area where the luminescent portion is disposed, the light-guide portion overlapping the light-guide sheet at the position.

2. The movable contact unit according to claim 1, wherein the light-guide portion is one of a plurality of light-guide portions, the movable contact unit further comprising a light-transmissive connecting portion connecting the plurality of light-guide portions.

3. The movable contact unit according to claim 1, wherein the light-guide portion comprises:

a belt-shaped portion; and a protrusion protruding from the belt-shaped portion.

4. The movable contact unit according to claim 3, wherein the luminescent portion is one of a plurality of luminescent portions, and the protrusion fills a space between two luminescent portions adjacent to each other in an oblique direction in the plurality of luminescent portions.

5. The movable contact unit according to claim 1, wherein the light-guide portion surrounds the luminescent portion.

6. The movable contact unit according to claim 1, wherein the light-guide portion is L-shaped, and is provided on an outer periphery of the movable contact unit.

7. A switch comprising:

a movable contact unit according to claim 1, a first light-emitting element provided at a position where the first light-emitting element can light an end of the light-guide portion;

a second light-emitting element provided at a position where the second light-emitting element can light an end of the substrate; and a wiring board having a face on which a central fixed contact and an outer fixed contact surrounding the central fixed contact are provided, an outer periphery of the movable contact being placed on the outer fixed contact, a center of the movable contact facing the central fixed contact with a predetermined distance in between.

8. A movable contact unit comprising:

a light-guide sheet including a film-shaped substrate, and a convex and concave luminescent portion provided on the substrate;

a movable contact attached to the light-guide sheet at a position corresponding to the luminescent portion, the movable contact being made of a dome-shaped resilient thin metal sheet; and a light-transmissive light-guide portion provided on the light-guide sheet at a position other than an area where the luminescent portion is disposed, the light-transmissive light-guide portion overlapping the light-guide sheet at the position.

9. The movable contact unit according to claim 8, wherein the light-guide portion is one of a plurality of light-guide portions, the movable contact unit further comprising a light-transmissive connecting portion connecting the plurality of light-guide portions.

10. The movable contact unit according to claim 8, wherein the light-guide portion comprises:

a belt-shaped portion; and a protrusion protruding from the belt-shaped portion.

11. The movable contact unit according to claim 10, wherein the luminescent portion is one of a plurality of luminescent portions, and the protrusion fills a space between two luminescent portions adjacent to each other in an oblique direction in the plurality of luminescent portions.

12. The movable contact unit according to claim 8, wherein the light-guide portion surrounds the luminescent portion.

13. The movable contact unit according to claim 8, wherein the light-guide portion is L-shaped, and is provided on an outer periphery of the movable contact unit.

14. A switch comprising:

a movable contact unit according to claim 8;

a first light-emitting element provided at a position where the first light-emitting element can light an end of the light-guide portion;

a second light-emitting element provided at a position where the second light-emitting element can light an end of the substrate; and a wiring board having a face on which a central fixed contact and an outer fixed contact surrounding the central fixed contact are provided, an outer periphery of the movable contact being placed on the outer fixed contact, a center of the movable contact facing the central fixed contact with a predetermined distance in between.

15. The movable contact unit according to claim 8, wherein the light-guide portion is provided on a surface of the light-guide sheet, the surface of the light-guide sheet facing the cover sheet.

16. The movable contact unit according to claim 8, wherein the light-guide portion overlaps the cover sheet and the light-guide sheet in a direction in which the cover sheet and the light-guide sheet face each other.

17. The movable contact unit according to claim 8, wherein a top face or bottom face of the light-guide portion is roughened or concavo-convex.

18. The movable contact unit according to claim 1, wherein the light-guide portion is provided on one of:

a surface of the cover sheet, the surface of the cover sheet facing the light-guide sheet; and a surface of the light-guide sheet, the surface of the light-guide sheet facing the cover sheet.

19. The movable contact unit according to claim 1, wherein the light-guide portion overlaps the cover sheet and the light-guide sheet in a direction in which the cover sheet and the light-guide sheet face each other.

20. The movable contact unit according to claim 1, wherein a top face or bottom face of the light-guide portion is roughened or concavo-convex.

* * * * *